US005988592A

United States Patent [19]

Sheppard

[11] Patent Number: 5,988,592

[45] Date of Patent: Nov. 23, 1999

[54] VALVES

[76] Inventor: Raymond William Sheppard, 7 Wythburn Close, Burnley, Lancashire, United Kingdom, BB1 28XE

[21] Appl. No.: 08/995,395

[22] Filed: Dec. 22, 1997

[30] Foreign Application Priority Data

Dec. 24, 1996 [GB] United Kingdom ..... 9626847

[51] Int. Cl.[6] ..... F16K 11/00

[52] U.S. Cl. ..... 251/342; 222/490; 137/243

[58] Field of Search ..... 251/342; 137/588; 222/490, 482, 560, 502, 96, 103, 105, 212, 213, 214

[56] References Cited

U.S. PATENT DOCUMENTS

| | | | |
|---|---|---|---|
| 2,578,864 | 12/1951 | Tupper | 239/327 |
| 2,730,274 | 1/1956 | Brown | 222/490 |
| 2,759,210 | 8/1956 | Cordis | 251/342 |
| 3,858,773 | 1/1975 | Del Bon | 222/494 |
| 4,473,094 | 9/1984 | Harris | 137/550 |
| 4,725,268 | 2/1988 | Ostensen et al. | 137/588 |

*Primary Examiner*—A. Michael Chambers
*Attorney, Agent, or Firm*—Gerald E. Hespos; Anthony J. Casella

[57] ABSTRACT

A valve in which an elastic member (26) containing a normally closed slit (28) is adapted to be selectively stretched by displacement of an actuating means, such as to stretch open the slit (28) over the outlet end (27) of a product discharge passage defined by a tube (24) and allow fluid product to be dispensed therefrom, release of the actuating means allowing the elastic member, and hence the distorted slit (28) to return to its original configuration, thereby reclosing the outlet end of the passage. The actuating means comprises a pair of relatively pivotable actuating members (30*a*, 30*b*) relative angular displacement of which is adapted to stretch open the slit (28) in the elastic member (26) over said outlet end (27) of the product discharge passage defined by the rigid tube (24).

13 Claims, 3 Drawing Sheets

FIG.1.
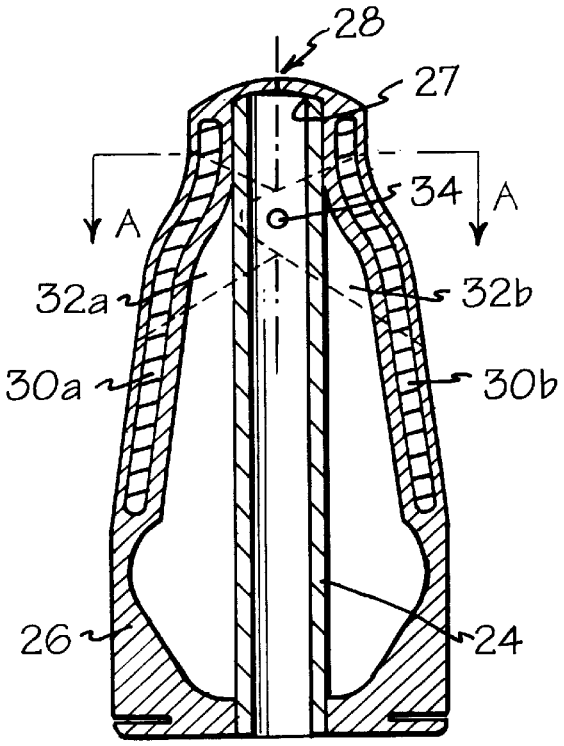
FIG.3.
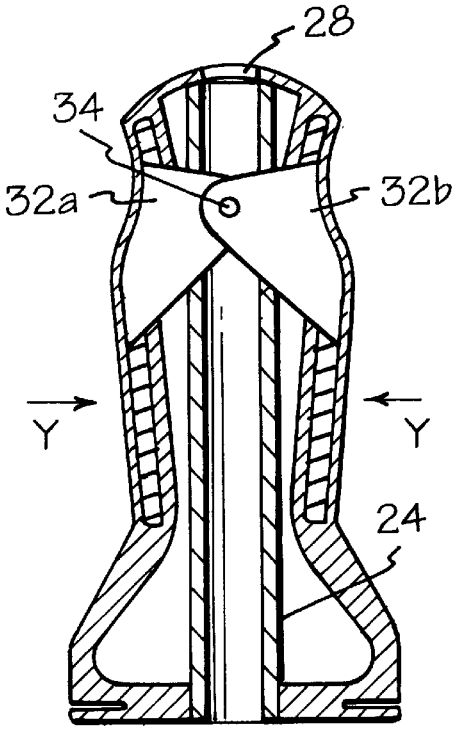
CLOSED POSITION
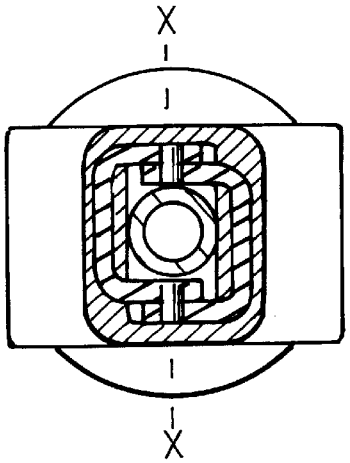
FIG.2.
OPEN POSITION
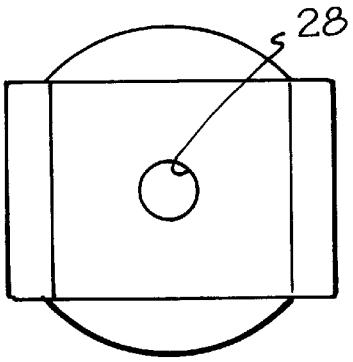
FIG.4.

FIG.8.
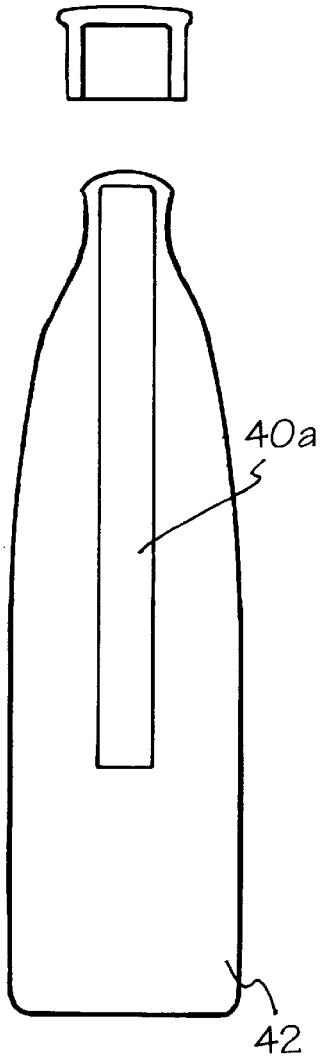
FIG.6.
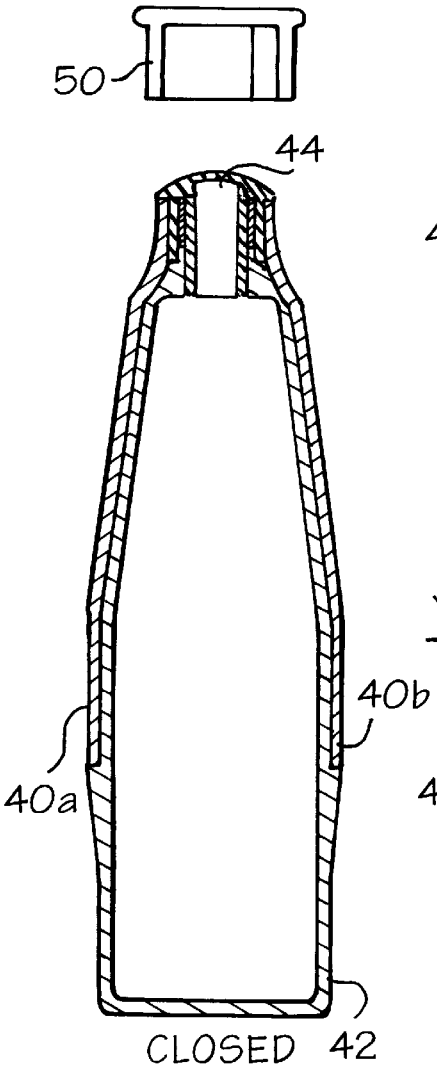
FIG.9.
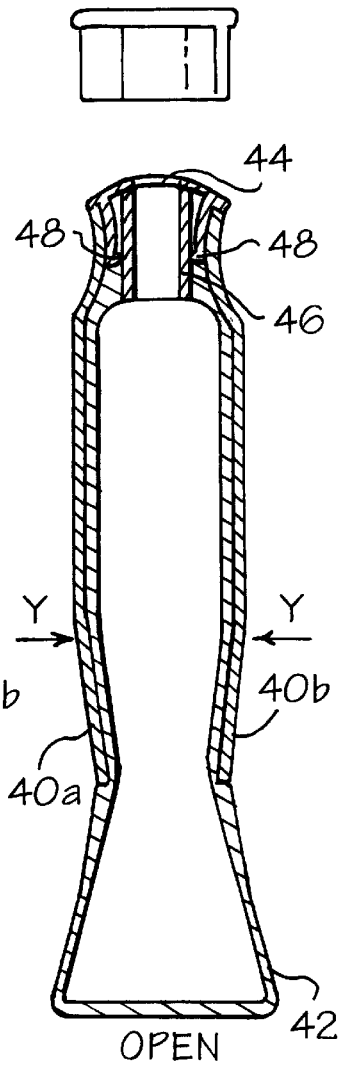
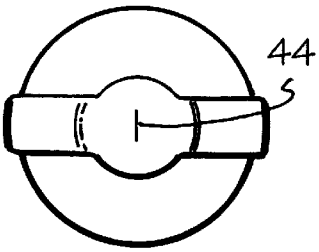
FIG.7.

FIG.11.
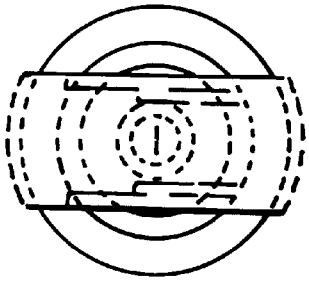
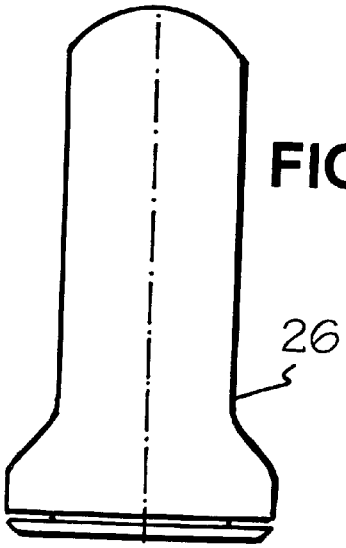
FIG.5.
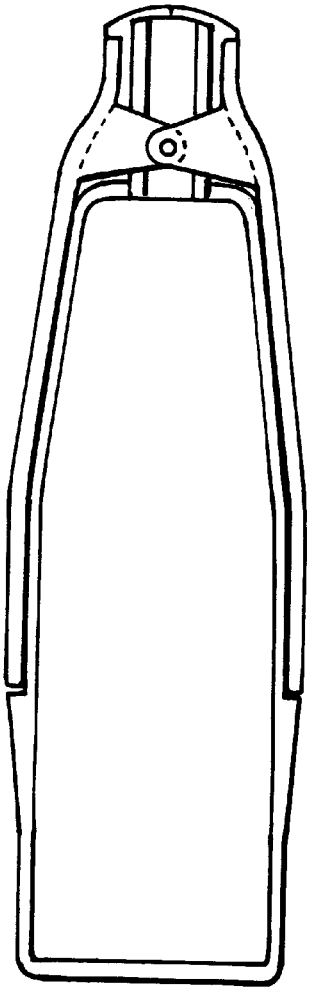
FIG.10.
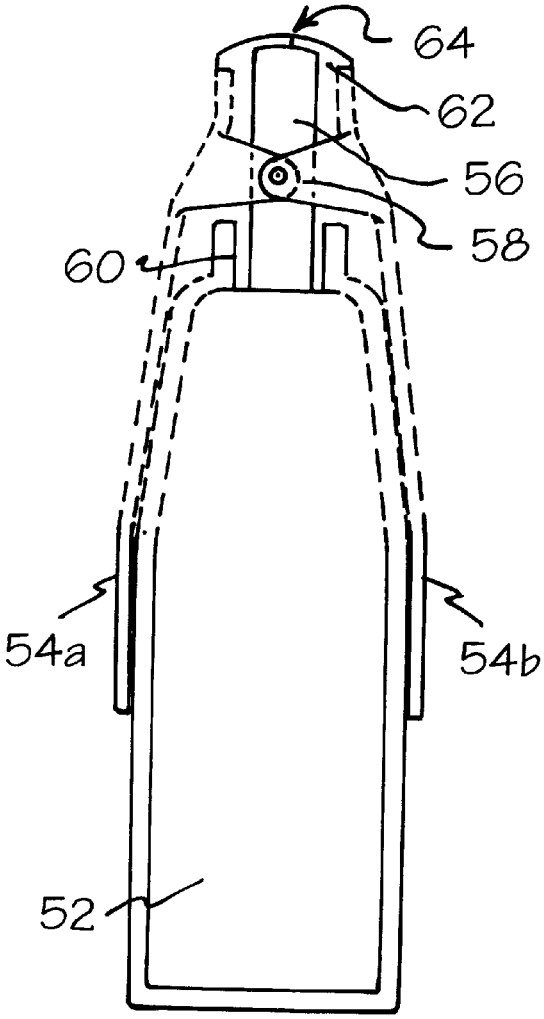
FIG.12.

VALVES

The present invention relates to valves. The invention is particularly, but not exclusively, applicable to valves for dispensers for dispensing edible fluid products.

Dispensers of this type are widely used as food containers and are adapted to dispense a required portion of a product, such as whipped cream, by manual operation of a delivery valve on the container, the food in the form of a jet or stream being emitted from the container via a nozzle of the delivery valve. A typical whipped cream (or other fluid food product) dispenser of this type usually comprises a piping tube forming the nozzle of the delivery valve, the piping tube being disposed externally to a sealable outlet of a main container body and being pivotally mounted on the container body such that when the nozzle/piping tube is pivoted manually towards, and pressed onto, the sealable outlet of the delivery valve by way of an actuator button, the delivery valve opens and the cream is dispensed via the nozzle/piping tube. Release of hand pressure from the nozzle actuator causes the delivery valve to close, thereby resealing the container.

However, a portion of dispensed cream will remain in the nozzle. It is therefore necessary to manually rotate the nozzle away from the delivery valve in order to allow running water, from a tap, to pour through the nozzle in order to remove the remaining cream. This is inconvenient for the user. Also, it is difficult to remove all traces of the remaining cream by this method. Residues of cream remaining in the nozzle will become contaminated and will consequently contaminate any further portions of cream dispensed from the container. Furthermore, the cream will set and a build-up of residues of cream within the nozzle will eventually block the nozzle, making it impossible to dispense any further portions of cream from the container. This is a particular problem if the nozzle has not actually been rinsed.

In order to overcome, or alleviate, the above described drawbacks of the conventional devices, it was proposed in my earlier EP Application No. 97307273.9 to provide a valve in which an elastic member containing a normally closed slit is adapted to be selectively stretched by displacement of an actuating member, such as to stretch open the slit over the outlet end of a product discharge passage and allow fluid product to be dispensed therefrom, release of the actuating member allowing the elastic member, and hence the distorted slot, to return to its original configuration, thereby reclosing the outlet end of the passage.

The contracting slit can be arranged to slide over the outlet end of the passage during its return to its original configuration, so as to re-close the outlet end of the passage with a self-wiping action.

This has the advantage that the outlet end of the product discharge passage can be fully closed by the elastic member in the non-stretched condition, whereby any product remaining in the passage will be sealed from the outside air and contamination of the product will be prevented. As a result of the self-wiping action of the elastic member over the outlet end of the product discharge passage, the outlet end of the passage is kept clean at all times when dispensing has been terminated. The use of a contracting aperture in an elastic member as the final outlet for the food product means that when the aperture finally closes, any food product therein is forcibly expelled by the inherent elasticity of the elastic member whereby all that is usually necessary to ensure a completely clean outlet is to run a tissue or cloth over the region around the slit once the slit has returned to its closed condition.

The product discharge passage is usually connected permanently to the interior of a container carrying the food product to be dispensed. In a typical case, the product would be housed in the container under pressure. However, in some embodiments, the product need not be permanently pressurised but could be expelled by, for example, squeezing flexible sides of the container.

It is an object of the present invention to provide a valve of the aforegoing type which operates particularly efficiently.

In accordance with the present invention, there is provided a valve in which an elastic member containing a normally closed slit is adapted to be selectively stretched by displacement of an actuating means, such as to stretch open the slit over the outlet end of a product discharge passage defined by a tube and allow fluid product to be dispensed therefrom, release of the actuating means allowing the elastic member and hence the distorted slit to return to its original configuration, thereby reclosing the outlet end of the passage, wherein the actuating means comprises relatively pivotable actuating members, relative angular displacement of which is adapted to stretch open the slit in the elastic member over said outlet end of the product discharge passage defined by the rigid tube.

Preferably, the slit is aligned at all times, whether open or closed, with the longitudinal axis of the tube.

Advantageously, the elastic member can be part of a housing which is adapted, in use, to be connected to an outlet of a container containing a fluid food product to be dispensed.

In some embodiments, the actuating members can be disposed in, on or within the side wall of said housing such that said relative angular displacement of the actuating members causes selective distortion of the housing which achieves opening/closing of the slit over the discharge end of said tube.

In some embodiments there are two of said relatively pivotable actuating members which are hinged together to enable said mutually pivoting action therebetween.

In other embodiments, there are two of said actively pivotable actuating members which each pivot about the rigid tube to enable said mutually pivoting action therebetween.

Advantageously, a valve in accordance with the present invention can be adapted for use with a non-pressurised container, wherein squeezing together/manual gripping of said actuating members to achieve said relative angular displacement therebetween and to thereby stretch open the slit over the end of the tube is itself adapted to squeeze a flexible container sufficiently to eject fluid product contained therein through the aperture formed by the open slit.

In some embodiments, the valve can be formed integrally with the container.

In other embodiments, the valve is selectably connectible to the container.

Preferably, the tube is rigid.

The invention is described further hereinafter, by way of example only, with reference to the accompanying drawings, wherein:

FIG. 1 is a schematic sectional side view of a first embodiment of a valve in accordance with the present invention, shown with the valve in its closed position;

FIG. 2 is a sectional view on line A—A in FIG. 1;

FIG. 3 is a schematic sectional side view corresponding to FIG. 1 but with the valve in its fully open position;

FIG. 4 is a plan view corresponding to FIG. 3;

FIG. 5 is an external front view of the first embodiment;

FIGS. 6 to 9 are diagrammatic illustrations of a second embodiment in accordance with the present invention, using a non-pressurised container;

FIGS. 10 and 11 show an alternative non-pressurised arrangement; and

FIG. 12 shows a still further non-pressurised arrangement wherein the squeeze mechanism can be removed from the bottle for use with multiple bottles.

Referring first to FIGS. 1 to 5, the valve illustrated in these figures comprises a rigid tube 24 defining a product discharge passage and which is held on the central longitudinal axis of a flexible, hollow housing 26 made of a food-grade plastics material and is chamfered arcuately at its discharge end 27. In use, the flexible housing 26 is adapted to be fitted to the top of a pressurised container (not shown) of fluid food product such as cream, custard or the like, in this case using a circumferential slot which engages over a top aperture of the pressurised container, whereby the tube 24 is in permanent connection with the interior of the pressurised container.

The flexible housing 26, which is preferably made of a stretchable material such as silicone rubber, is closed over the chamfered discharge end 27 of the central tube 24 except for a linear slit 28 which extends diametrically across the end of the tube 24 in a direction perpendicular to the plane of the drawing, as viewed in FIG. 1, so as normally to close the tube 24 and prevent the ejection of the pressurised food product.

The flexibility of the material of the housing 26 is used to enable the slit 28 to be stretched open across the chamfered end of the tube 24 and thereby enable the pressurised food product to be dispensed from the container. For this purpose, the side wall of the housing 26 has a pair of rigid inserts 30*a*, 30*b*, which are curved in this example and are preferably of a rigid plastics or metal, interconnected by side flanges 32*a*, 32*b* which are hinged together at 34 so as to be mutually pivotable about an axis x—x (see FIG. 2) through the hinges. By applying manual gripping pressure to the two sides of the housing 26, as indicated by the arrows Y in FIG. 3, the inserts 30*a*, 30*b* can be pivoted about the hinges 34 to the position shown in FIG. 3 whereby the housing material covering the slit 28 is stretched such that the slit 28 is opened up so as to uncover the chamfered end of the tube 24 and allow the pressurised food product to be dispensed from the tube 24 via the open slit. Release of the gripping pressure on the rigid inserts 30*a*, 30*b* allows the container to return to its original shape under its inherent elasticity, the slit 28 returning to its closed (FIG. 1) position, thereby cutting off the supply of the food product. In this movement, the underside of the housing portion adjacent the slit 28 slides over the "sharp" end of the tube 24 which assists in resisting the build-up of food product in this region. Furthermore, the resilient/elastic nature of the material defining the slit results in remanent food product being forcibly expelled from the slit as it returns to its closed condition, again therefor assisting in preventing the build-up of food product in the slit region.

Referring now to FIGS. 6 to 9, there is illustrated diagrammatically a further embodiment wherein the valve arrangement of the present invention is used in connection with a non-pressurised container. In this case, the squeezing together/manual gripping of opposed rigid actuating members 40*a*, 40*b* (corresponding to the inserts 30*a*, 30*b* of the embodiment of FIGS. 1 to 5) in the directions of the arrows Y to stretch open the slit 44 over the end of the rigid tube 46 is itself adapted to squeeze a flexible container 42 sufficiently to eject the fluid product through the aperture formed by the opened slit 44. The tube 44 is shorter than that used in first embodiment and only needs to communicate with the interior of the container 42, as seen in FIGS. 6 and 9. In this embodiment, the actuating members are disposed externally of the container and are simply pivoted on the tube 46 at 48 as an alternative to the hinged arrangement of FIGS. 1 to 5. As in all embodiments, an anti-tamper cap 50 can be applied to cover the dispensing end of the valve arrangement.

FIGS. 10 and 11 show diagrammatically a further non-pressurised container embodiment, similar to that of FIGS. 6 to 9, but using the hinge arrangement of FIGS. 1 to 5.

FIG. 12 shows a still further embodiment which is similar to that of FIGS. 10 and 11 but wherein the valve mechanism is formed entirely separately from the container/bottle 52 so that it can be used transferably with a multiplicity of containers/bottles 52. In this case, the valve mechanism, incorporating the actuating members 54*a*, 54*b*, tube 56, hinges 58 and stretchable valve diaphragm 62 containing the slit 64, is formed as a unitary mechanism which can be selectively fitted to the container/bottle 52 at 60, either by screw-fitting or by a push-fit.

In the case of embodiments where the container/bottle is non-pressurised it is appropriate to provide some means by which external air can be sucked into the container when liquid food product has been squeezed out so as to enable the container to return to its original shape when it is released. Provision should preferably be made for such air to be filtered, for example by way of a micro-filter disposed on the cap or in the container wall. Advantageously, the latter means can include a one-way valve to prevent food product exiting via the filter.

In all cases, the flexible diaphragm forming the openable slit is preferably made of a good-grade elastomer.

Because the valves of the present invention are self-sealing, they are particularly well adapted to provide the discharge valve/nozzle for a container of an edible product. This allows any product remaining in the discharge valve/nozzle to be sealed from the environment, thereby preventing contamination of the product.

I claim:

1. A valve in which an elastic member containing a normally closed slit is adapted to be selectively stretched by displacement of an actuating means, such as to stretch open the slit over and in sliding engagement with an arcuately chamfered outlet end of a product discharge passage defined by a rigid tube and allow fluid product to be dispensed therefrom, release of the actuating means allowing the elastic member, and hence the distorted slits, to return to its original configuration by sliding over the arcuately chamfered outlet end of the tube, thereby reclosing the outlet end of the passage with a self-wiping action, wherein the actuating means comprises relatively pivotable actuating members, relative angular displacement of which is adapted to stretch open the slit in the elastic member over and in sliding engagement with said arcuately chamfered outlet end of the product discharge passage defined by the rigid tube.

2. A valve as claimed in claim 1, wherein the elastic member is part of a housing which is adapted, in use, to be connected to an outlet of a container containing a fluid food product to be dispensed.

3. A valve as claimed in claim 2, wherein said actuating members are in any of disposed in, disposed on and disposed within the side wall of said housing such that said relative angular displacement of the actuating members causes selective distortion of the housing which achieves opening/closing of the slit over the discharge end of said tube.

4. A valve as claimed in claim 3, wherein the slit is aligned at all times, whether open and closed, with the longitudinal axis of the tube.

5. A valve as claimed in claim 4, wherein there are two of said relatively pivotable actuating members which are hinged together to enable said mutual pivoting action therebetween.

6. A valve as claimed in claim 4, wherein there are two of said relatively pivotable actuating members which each pivot about the rigid tube to enable said mutual pivoting action therebetween.

7. A valve as claimed in claim 4, for use with a non-pressurised container, wherein squeezing together/manual gripping of said actuating members to achieve said relative angular displacement therebetween and to thereby stretch open the slit over the end of the tube is itself adapted to squeeze a flexible container sufficiently to eject fluid product contained therein through the aperture formed by the open slit.

8. A valve as claimed in claim 7, wherein the valve is formed integrally with the container.

9. A valve as claimed in claim 7, wherein the valve is selectably connectible to the container.

10. A valve as claimed in claim 1, wherein the tube is rigid.

11. A valve for use in dispensing fluid product from a non-pressurized container, in which an elastic member containing a normally closed slit is adapted to be selectively stretched by displacement of an actuating means, such as to stretch open the slit over and in sliding engagement with an arcuately chamfered outlet end of a product discharge passage defined by a rigid tube and allow fluid product to be dispensed therefrom, release of the actuating means allowing the elastic member, and hence the distorted slits, to return to its original configuration by sliding over the arcuately chamfered outlet end of the tube, thereby reclosing the outlet end of the passage with a self-wiping action, wherein the actuating means comprises relatively pivotable actuating members, relative angular displacement of which is adapted to stretch open the slit in the elastic member over said outlet end of the product discharge passage defined by the rigid tube and wherein squeezing together/manual gripping of said actuating members to achieve said relative angular displacement therebetween and to thereby stretch open the slit over and in sliding engagement with said arcuately chamfered end of the tube is itself adapted to squeeze a flexible container sufficiently to eject fluid product contained therein through the aperture formed by the open slit.

12. A container having a mouth at one end, a longitudinally extending side wall, and a closure valve for selectably closing sand mouth, said closure valve comprising an elastic member containing a normally closed slit which is adapted to be selectively stretched by displacement of an actuating means, such as to stretch open the slit over and in sliding engagement with an arcuately chamfered outlet end of a product discharge passage defined by a rigid tube and allow fluid product to be dispensed therefrom, release of the actuating means allowing the elastic member, and hence the distorted slit, to return to its original configuration by sliding over the arcuately chamfered outlet end of the tube, thereby reclosing the outlet end of the passage with a self-wiping action, wherein the actuating means comprises relatively pivotable actuating members, relative angular displacement of which is adapted to stretch open the slit in the elastic member over and in sliding engagement with said arcuately chamfered outlet end of the product discharge passage defined by the rigid tube, the actuating members being disposed within the thickness of said longitudinal side wall of said container.

13. A valve arrangement for mounting on a container to enable an arcuately chamfered tubular outlet end of the container to be selectably opened and closed, the valve comprising an elastic member containing a normally closed slit which is adapted to be selectively stretched by displacement of an actuating means, such as to stretch open the slit over and in sliding engagement with said arcuately chamfered tubular outlet end of said container and allow fluid product to be dispensed therefrom, release of the actuating means allowing the elastic member, and hence the distorted slit, to return to its original configuration by sliding over the arcuately chamfered tubular outlet end of the container, thereby reclosing said outlet end with a self-wiping action, wherein the actuating means comprises actuating members which are adapted to lie internally of the container and are relatively pivotable on said tubular outlet end of the container for stretching open the slit in the elastic member over and in sliding engagement with said arcuately chamfered tubular outlet end.

* * * * *